US010674274B2

(12) United States Patent
Song

(10) Patent No.: US 10,674,274 B2
(45) Date of Patent: Jun. 2, 2020

(54) SPEAKER

(71) Applicant: AAC Technologies Pte. Ltd., Singapore (SG)

(72) Inventor: Wei Song, Shenzhen (CN)

(73) Assignee: AAC Technologies Pte, Ltd., Singapore (SG)

( * ) Notice: Subject to any disclaimer, the term of this patent is extended or adjusted under 35 U.S.C. 154(b) by 0 days.

(21) Appl. No.: 16/524,068

(22) Filed: Jul. 28, 2019

(65) Prior Publication Data

US 2020/0045448 A1 Feb. 6, 2020

(30) Foreign Application Priority Data

Aug. 4, 2018 (CN) ..... 2018 2 1261974 U

(51) Int. Cl.

| | |
|---|---|
| ***H04R 9/04*** | (2006.01) |
| ***H04R 9/06*** | (2006.01) |
| ***H04R 9/02*** | (2006.01) |
| ***H04R 7/16*** | (2006.01) |
| ***H04R 7/12*** | (2006.01) |

(52) U.S. Cl.

CPC ..... *H04R 9/045* (2013.01); *H04R 7/16* (2013.01); *H04R 9/025* (2013.01); *H04R 9/06* (2013.01); *H04R 7/127* (2013.01); *H04R 2400/11* (2013.01); *H04R 2499/11* (2013.01)

(58) Field of Classification Search

CPC ..... H04R 9/025; H04R 9/06; H04R 31/006; H04R 9/045; H04R 7/20; H04R 7/18; H04R 9/02; H04R 9/043; H04R 1/06; H04R 2209/022; H04R 2209/024; H04R 2400/11; H04R 2499/11; H04R 2499/13; H04R 7/04; H04R 7/16; H04R 9/046; H04R 9/063; H04R 1/025

USPC ..... 381/401, 403, 405, 404, 407, 418, 431, 381/396, 398

See application file for complete search history.

(56) References Cited

U.S. PATENT DOCUMENTS

| | | | | |
|---|---|---|---|---|
| 5,123,053 A * | 6/1992 | House | ..... | H04R 9/06 181/157 |
| 6,778,677 B2 * | 8/2004 | Coffin | ..... | H04R 9/025 381/401 |
| 7,856,115 B2 * | 12/2010 | Clair | ..... | H04R 1/403 381/398 |

* cited by examiner

*Primary Examiner* — Alexander Krzystan
*Assistant Examiner* — Julie X Dang
(74) *Attorney, Agent, or Firm* — W&G Law Graup LLP

(57) ABSTRACT

The present disclosure provides a speaker having a magnetic yoke with a receiving space, a magnet coupled to the magnetic yoke, a diaphragm located above the magnetic yoke, and a coil assembly for driving the diaphragm. The magnetic yoke includes a bottom for carrying a first magnet, and a supporting portion extending from the bottom. The magnet includes a first magnet on the bottom and a second magnet mounted on the supporting portion. The speaker further includes a suspension accommodated in the receiving space. The suspension is used for supporting the coil assembly for providing balanced vibration to the diaphragm.

11 Claims, 5 Drawing Sheets

SPEAKER

FIELD OF THE PRESENT DISCLOSURE

The present disclosure relates to the field of electromagnetic transducers, more particularly to a speaker used in a portable electronic device.

DESCRIPTION OF RELATED ART

A speaker is a very important component equipped in a mobile phone for producing audible sounds. A speaker generally uses a diaphragm to produce vibration and further to generate sounds.

In order to adapt to miniaturization and multifunctional development of various audio equipment and information communication equipment, the speaker used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. The coil is fixedly supported by only the vibrating diaphragm, and when the vibrating system vibrates, unbalanced vibration is easily generated. The power is required to be reduced to meet the balance of the vibration system, and therefore the power of the vibration system is limited. So that the acoustic performance of the speaker using the vibration system is limited. Therefore, an improved speaker is desired.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain the disclosure, not intended to limit the disclosure.

Figure 1:
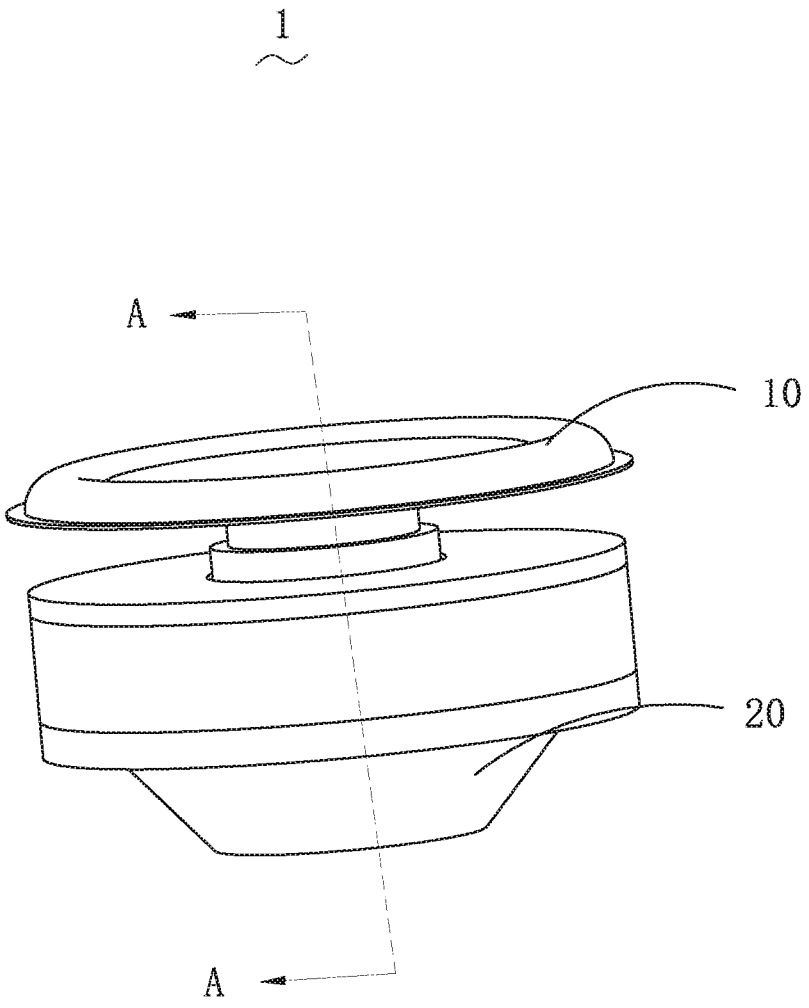
FIG. 1 is an isometric view of a speaker in accordance with a first exemplary embodiment of the present disclosure.
Figure 2:
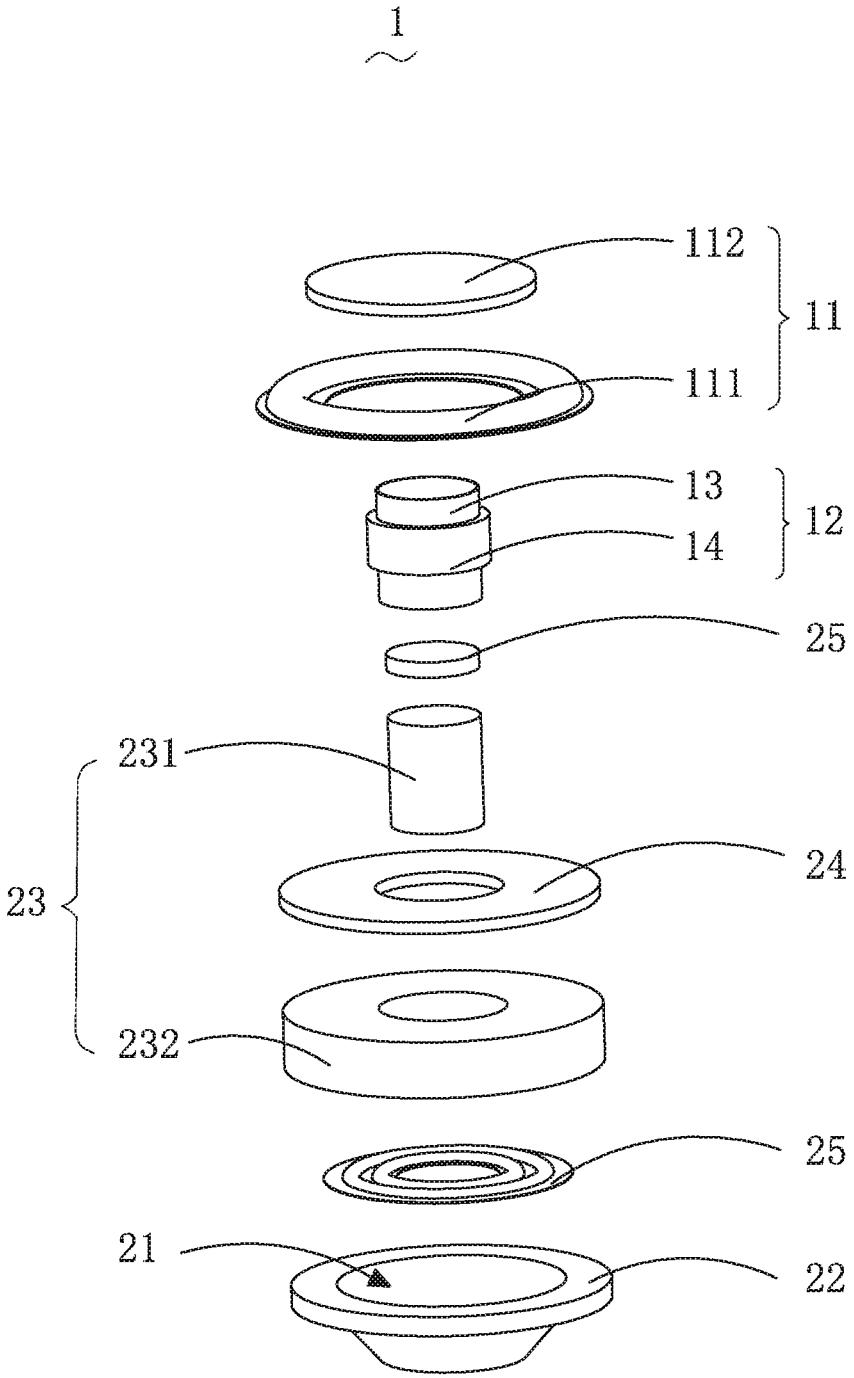
FIG. 2 is exploded view of the speaker in FIG. 1.

Referring to FIGS. 1-2, a speaker, in accordance with an exemplary embodiment of the present disclosure, includes a vibration system 10 and a magnetic circuit system 20. The vibration system 10 includes a diaphragm 11 and a coil assembly 12 for driving the diaphragm 1. In the embodiment, the coil assembly 12 includes a frame 13 and a coil 14 wound around the frame 13. Alternatively, the coil assembly 12 may comprises only a coil. The diaphragm 11 includes a flexible portion 111 and a dome 112 attached to/integral with the flexible portion 111.

The magnetic circuit system 20 includes a magnetic yoke 22 with a receiving space 21, and a magnet 23 for interacting with the coil assembly 12. The magnetic yoke 22 and the magnet 23 cooperatively form a magnetic gap.

Figure 3:
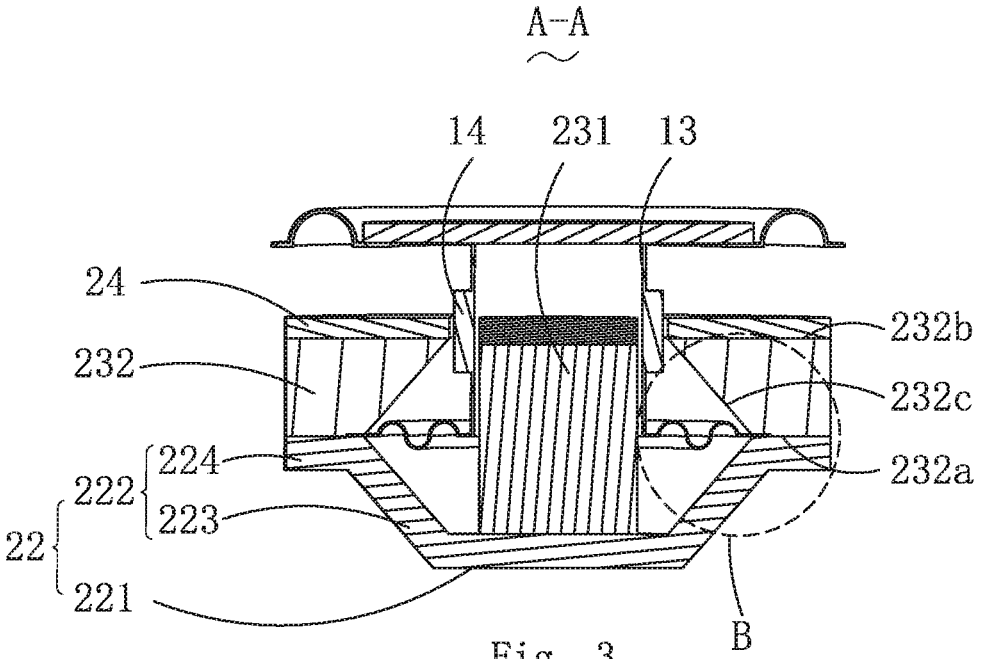
FIG. 3 is a cross-sectional view of the speaker in FIG. 1, taken along line A-A.
Figure 4:
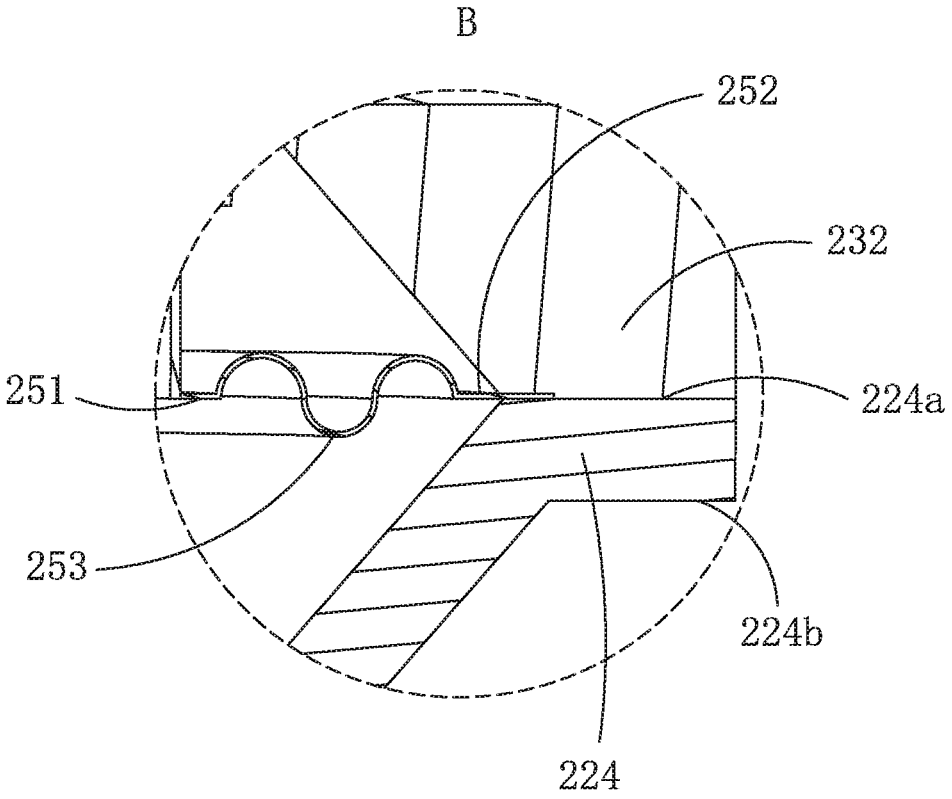
FIG. 4 is an enlarged view of Part B in FIG. 3.

Referring to FIGS. 3-4, the magnetic yoke 22 includes a bottom 221 and a supporting portion 222 extending from the bottom 221. The supporting portion 222 includes a first oblique portion 223 extending outwardly from an edge of the bottom 221 for enlarging an outer diameter of the magnetic yoke, and a first horizontal portion 224 extending along a direction perpendicularly to a vibration direction of the diaphragm for further enlarging the outer diameter of the magnetic yoke 22. The magnet 23 includes a first magnet 231 fixed on the bottom 221 and a second magnet 232 fixed on the horizontal portion 224. The magnetic yoke 22 and the second magnet 232 forms the receiving space 21. The second magnet 232 includes a first end surface 232*a* adjacent to the horizontal portion 224, a second end surface 232*b* adjacent to the diaphragm 11, and an inner surface 232*c* connecting the first end surface 232*a* to the second end surface 232*b* and adjacent to the first magnet 231. The inner surface 232*c* extends from an edge of the first end surface 232*a* toward the diaphragm 11 and the coil assembly 12. The magnetic circuit system 20 further includes a magnetic plate 24 covering the second end surface 232*b* and a pole plate 26 covering the first magnet 231. A projection of the pole plate 26 along the vibration direction coincides with a projection of the first magnet 231 along the same direction. The first horizontal portion 24 has a projection along the vibration direction coinciding with a projection of the first end surface 232*a* along the same direction. The magnetic plate 24 has a projection along the vibration direction coinciding with a projection of the second end surface along the same direction.

The speaker 1 further includes a suspension 25 received in the receiving space 21. The suspension 25 includes a first fastening portion 251, a second fastening portion 252, and a connecting portion 253 connecting the first fastening portion 251 to the second fastening portion 252. The first fastening portion 251 connects to an end of the coil assembly 12, and the second fastening portion 252 is sandwiched between the first and second fastening portions 251, 252. The suspension 25 has a waved cross-section taken along the vibration direction for improving flexibility thereof. Optionally, the cross-section of the suspension 25 along the vibration direction can be other forms, like a straight line, or an arc.

As an improvement, the first fastening portion 251 of the suspension 25 connects to the frame 13 of the voice coil at an end far away from the diaphragm, and the frame of the voice coil at least partially surrounds the first magnet.

Figure 5:
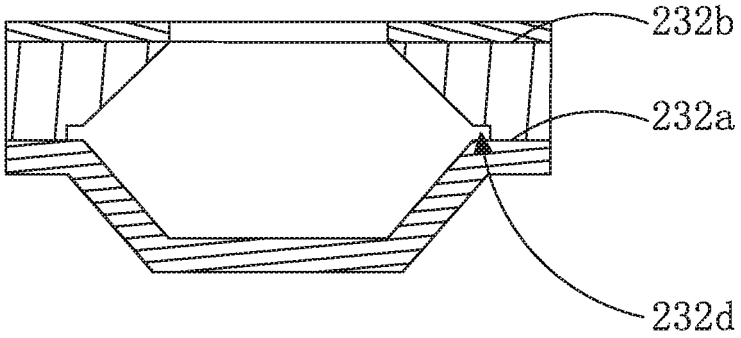
FIG. 5 is a cross-sectional view of a speaker of an alternative exemplary embodiment.

FIG. 5 provides an alternative embodiment which further includes a second fastening slot 232*d* formed in the first end surface 232*a*. By virtue of such a configuration, the second fastening portion 252 of the suspension 25 is fixed in the fastening slot 232*d*. The stability of the connection between the suspension and the magnetic circuit system is firmed. Referring to FIGS. 3-5, specifically, the first horizontal portion 224 includes a first upper surface 224*a* adjacent to the first end surface 232*a* and a first lower surface 224*b* opposite to the first upper surface 224*a*. The second fastening slot 232*d* is formed by recessing from the first end surface 232*a* toward the second end surface 232*b*. The suspension 25 is fastened in the second fastening slot 232*d*.

Figure 6:
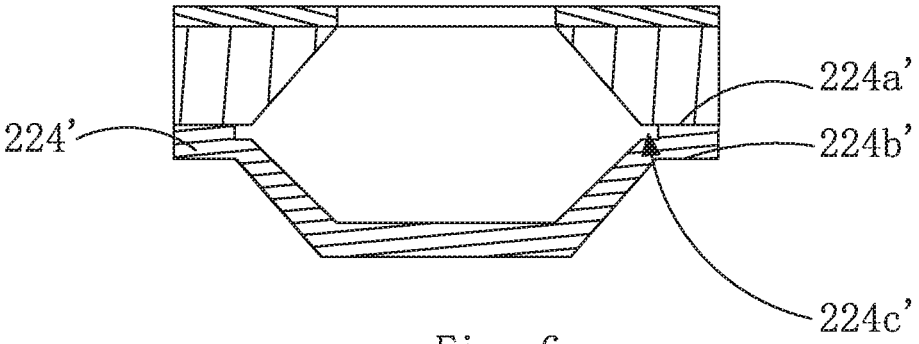
FIG. 6 is a cross-sectional view of a speaker of another alternative exemplary embodiment.

FIG. 6 shows another alternative embodiment disclosing that a first fastening slot 224*c*' is formed in the first horizontal portion 224' by recessing from the first upper surface 224*a*' toward the first lower surface 224*b*', by which the second fastening portion of the suspension is fixed.

Figure 7:
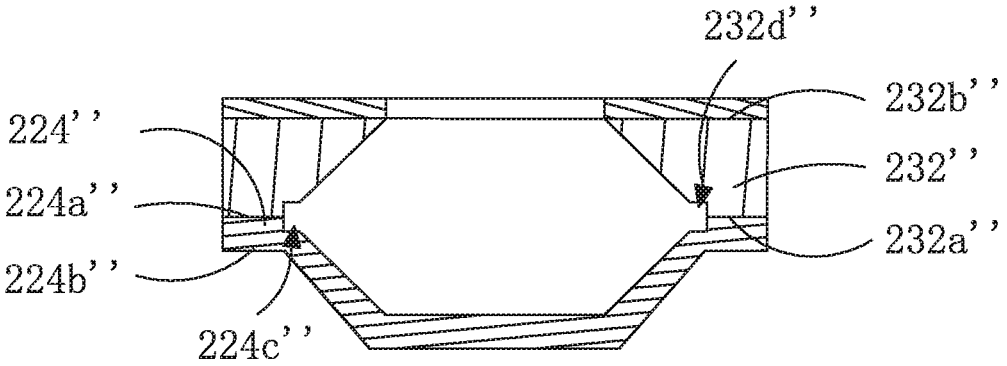
FIG. 7 is a cross-sectional view of a speaker of another alternative exemplary embodiment.

FIG. 7 indicates another embodiment disclosing that the fastening slot is cooperatively formed by a recess 224*c*" formed in the first horizontal portion 224" and a recess 232*d*" formed in the first end surface 232*a*" of the second magnet 232". Specifically, the first horizontal portion 224" includes a first fastening slot 224*c*" recessed from the first upper surface 224*a*" toward the first lower surface 224*b*". And the second magnet 232" includes a second fastening slot 232*d*" recessed from the first end surface 232*a*" toward the second end surface 232*b*". The suspension 25" is fixed by the first and second fastening slots 224*c*", 232*d*".

The present disclosure provides a speaker having a magnetic yoke with a receiving space, a magnet coupled to the magnetic yoke, a diaphragm located above the magnetic yoke, and a coil assembly for driving the diaphragm. The magnetic yoke includes a bottom for carrying a first magnet, and a supporting portion extending from the bottom. The magnet includes a first magnet on the bottom and a second magnet mounted on the supporting portion. The speaker further includes a suspension accommodated in the receiving space. The suspension is used for supporting the coil assembly for providing balanced vibration to the diaphragm.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising:

a vibration system including a diaphragm and a coil assembly for driving the diaphragm to vibrate along a vibration direction;

a magnetic circuit system including a magnetic yoke with a receiving space and a magnet for interacting with the coil assembly;

a suspension received in the receiving space for supporting the coil assembly at one end of the coil assembly far away from the diaphragm; wherein the magnetic yoke includes a bottom, a first oblique portion extending outwardly from the bottom toward the diaphragm, and a horizontal portion extending outwardly from the first oblique portion;

the magnet includes a first magnet mounted on the bottom and a second magnet carried by the horizontal portion; and the second magnet and the magnetic yoke cooperatively form the receiving space for receiving the suspension.

2. The speaker as described in claim 1, wherein the second magnet includes a first end surface adjacent to the horizontal portion, a second end surface adjacent to the diaphragm, and an inner surface adjacent to the first magnet for connecting the first end surface to the second end surface; and the inner surface extends inwardly from the first end surface to the second end surface.

3. The speaker as described in claim 2, wherein the magnetic circuit system further includes a magnetic plate covering the second end surface.

4. The speaker as described in claim 2, wherein a projection of the first horizontal portion coincides with a projection of the first end surface of the second magnet along the vibration direction, and a projection of the magnetic plate coincides with a projection of the second end surface along the vibration direction.

5. The speaker as described in claim 2, wherein the suspension includes a first fastening portion for connecting with an end of the coil assembly in a magnetic gap, a second fastening portion sandwiched between the first horizontal portion and the second magnet, and a connecting portion for connecting the first fastening portion to the second fastening portion.

6. The speaker as described in claim 5, wherein the suspension includes a waved cross-section taken along the vibration direction.

7. The speaker as described in claim 5, wherein the first horizontal portion includes a first upper surface adjacent to the first end surface and a first lower surface opposite to the first upper surface; the first horizontal portion includes a first fastening slot recessed from the first upper surface toward the first lower surface, and/or the second magnet includes a second fastening slot recessed from the first end surface toward the second end surface; and wherein the second fastening portion of the suspension is fixed in the first fastening slot and/or in the second fastening slot.

8. The speaker as described in claim 7, wherein each of the horizontal potion and the second end surface forms a slot for cooperatively forming the fastening slot for fixing the second fastening portion of the suspension.

9. The speaker as described in claim 1, wherein the coil assembly includes a frame and a coil wound around the frame, the first positioning portion connects to the frame at an end far away from the diaphragm, and the frame at least partially surrounds the first magnet.

10. The speaker as described in claim 9, wherein a projection of the second magnet along a direction perpendicularly the vibration direction partially falls on the coil.

11. The speaker as described in claim 1 further including a pole plate covering the first magnet.

* * * * *